US008388811B2

(12) United States Patent
Köckritz

(10) Patent No.: US 8,388,811 B2
(45) Date of Patent: Mar. 5, 2013

(54) SEAMABLE PRESS FELT WITH FLAT MANUFACTURED CARRIER STRUCTURE WHICH IS NOT WOVEN

(75) Inventor: Uwe Köckritz, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 386 days.

(21) Appl. No.: 12/752,672

(22) Filed: Apr. 1, 2010

(65) Prior Publication Data

US 2010/0252219 A1 Oct. 7, 2010

(30) Foreign Application Priority Data

Apr. 2, 2009 (DE) ..... 10 2009 002 121

(51) Int. Cl.
*D21F 7/08* (2006.01)
*B32B 5/08* (2006.01)

(52) U.S. Cl. ..... 162/358.2; 162/900; 442/402

(58) Field of Classification Search ..... 162/358.2, 162/900, 902–904, 348, 358.1; 139/383 AA, 139/425 A; 28/110, 142; 442/270, 402
See application file for complete search history.

(56) References Cited

U.S. PATENT DOCUMENTS

| | | | | |
|---|---|---|---|---|
| 3,948,722 | A * | 4/1976 | Wheeldon et al. | 162/289 |
| 4,948,658 | A | 8/1990 | Halker | |
| 6,283,165 | B1 * | 9/2001 | Best | 139/383 A |
| 2009/0090425 | A1 * | 4/2009 | Hawes et al. | 139/383 AA |

FOREIGN PATENT DOCUMENTS

| | | | |
|---|---|---|---|
| EP | 0261488 | B1 | 3/1988 |
| WO | 8912717 | A1 | 12/1989 |
| WO | WO 89/12717 | * | 12/1989 |

OTHER PUBLICATIONS

European Search Report for EP10157263 dated Jun. 28, 2010.

* cited by examiner

*Primary Examiner* — Eric Hug
(74) *Attorney, Agent, or Firm* — Taylor IP, P.C.

(57) ABSTRACT

The present invention relates to a press felt for a machine for the production and/or processing of a fibrous web including a carrier structure which fundamentally influences the dimensional stability of the felt. The carrier structure includes a flat manufactured textile fabric formed from longitudinal threads, transverse threads crossing the longitudinal threads, and sewing threads which connect the longitudinal and transverse threads with each other at the crossing points. The textile fabric is longer than the carrier structure and is laid onto itself in sections such that the carrier structure is formed by several layers of the textile fabric, extending respectively along the entire length of the carrier structure. The layers are connected with each other, at least in sections. Due to the placement of the sections of the textile fabric on top of each other, turned over edges which extend transversely to the longitudinal direction of the carrier structure are formed defining transverse ends of the carrier structure. In an area of the turned over edges, the longitudinal threads have a curved progression to form seam loops on the respective transverse ends, whereby the carrier structure is seamable in a paper machine in that the two transverse ends of the carrier structure are brought together to make the carrier structure continuous and the seam loops are meshed with each other, thus forming a connecting channel extending in the cross direction of the carrier structure. To make the carrier structure continuous, a pintle wire is inserted through the connecting channel.

14 Claims, 4 Drawing Sheets

SEAMABLE PRESS FELT WITH FLAT MANUFACTURED CARRIER STRUCTURE WHICH IS NOT WOVEN

BACKGROUND OF THE INVENTION

1. Field of the Invention

The present invention relates to a seamable press felt for a machine for the production and/or processing of a fibrous material web, for example a paper, cardboard or tissue web, as well as to a method for its manufacture.

2. Description of the Related Art

Press felts normally consist of a tensile load accommodating carrier structure which also essentially provides the dimensional stability of the press felt. The carrier structures of current seamable press felts are often woven on a circular loom, whereby the machine direction threads are reverse woven, thereby forming seam loops. The disadvantage of structures which are woven on circular looms is that the circular weaving process is time intensive and expensive. Furthermore, the length of such carrier structures is limited to the width of the weaving loom utilized in the weaving process, since the warp threads represent the cross machine direction threads and the weft threads represent the machine direction threads.

In order to replace expensive circular weaving, the state of the art known from WO89/12717 suggests seamable press felts with flat woven carrier structures. With these press felts, the flat woven fabric is laid onto itself thus forming turned over edges, whereby cross direction threads are removed from the woven fabric in the area of the turned over edges. In this case, the machine direction threads of the woven fabric provide the seam loops of the seamable press felt in the area of the turned over edges. The process described in WO89/12717 permits simple manufacture of woven fabrics which are then fabricated to the appropriate dimensions for the press felt which is to be produced.

Especially in press felt applications there has been a long felt need to replace the woven fabrics, which are expensive to produce, with laid structures and/or knitted structures, since laid or knitted structures can be produced faster (often at 10 times the speed) compared to woven structures.

It is known from EP0261488 to construct the carrier structure of a press felt from a flat manufactured warp knit structure and to lay the structure onto itself thereby forming turned over edges, analog to the method cited in WO89/12717. However, in EP0261488 the seam loops are provided by means of additional wire spirals which are attached to the warp knit fabric structure in the area of the turned over edges. Due to this arrangement, the structure of the press felt in the seam area presents a considerable unevenness compared to the rest of the press felt, which can lead to vibrations during the operation of such press felts and marking of the paper produced on these press felts.

What is needed in the art is a press felt whereby a seam can be produced in the machine and which has a non-marking carrier structure that is inexpensive to produce.

SUMMARY OF THE INVENTION

The present invention provides a press felt for a machine for the production and/or processing of a fibrous material web, especially paper, cardboard or tissue web. The press felt has a carrier structure which fundamentally influences the dimensional stability of the felt. Here, the carrier structure includes a flat manufactured textile fabric which is formed from longitudinal threads and transverse threads crossing the longitudinal threads, as well as sewing threads which connect the longitudinal and transverse threads with each other at the crossing points.

The textile fabric of the press felt according to the present invention is longer than the length of the carrier structure and is laid onto itself in sections in such a way that the carrier structure is formed by several layers of the textile fabric, extending respectively along the entire length of the carrier structure. Hereby, the layers which are arranged on top of each other are connected with each other, at least in sections.

Due to the placement of the sections of the textile fabric on top of each other, turned over edges are formed which extend transversely to the longitudinal direction of the carrier structure and which define one and one other transverse end of the carrier structure. In the area of the turned over edges, the longitudinal threads have a curved progression in order to form seam loops on the two respective transverse ends of the carrier structure. The carrier structure is seamable in a paper machine in that the two transverse ends of the carrier structure are brought together in order to make the carrier structure continuous and the seam loops are caused to mesh with each other by forming a connecting channel extending in the cross direction of the carrier structure. In order to join the two transverse ends of the carrier structure, a pintle wire is inserted through the connecting channel of the carrier structure.

The present invention further provides a press felt with a carrier structure which is not woven and which includes longitudinal as well as cross directional threads. The longitudinal threads represent the elements which absorb at least the substantial part of the tensile load occurring on the press felt. The cross directional threads determine at least the substantial part of the transverse stability of the press felt. Since in the press felt according to the present invention the longitudinal threads also provide the seam loops, the wire pintles in the seam area, as suggested in EP0261488, are not necessary. Since the press felt according to the present invention has a carrier structure which includes a textile fabric which is not woven or even consists entirely of such, the carrier structure can be manufactured easily and, therefore, cost effectively.

The sections of the textile fabric placed upon itself can represent two or more entire layers. If the carrier structure is, for example a 2-ply structure—meaning that it is formed by two layers of the textile fabric, each of which extends over the length of the carrier structure—then the two end sections of the flat manufactured textile fabric can, for example, be placed on the center section of the textile fabric in such a way that they combine to complete a layer which completely covers the center section. In this case, the textile fabric is therefore approximately twice as long as the carrier structure and the press felt.

The carrier structure may also include three layers of the textile fabric or may be formed by these. In this case, the textile fabric may, for example, be divided into three sections of identical length, for example into two end sections and one center section which are laid onto each other whereby, for example, the one end section completely covers the one side of the center section and the other end section completely covers the other opposite side of the center section.

The sections of the textile fabric which are laid on top of each other may, be joined with each other through sewing or needling. In the last mentioned case, the sections can be joined with each other, for example, through a needle bonded nonwoven structure consisting of staple fibers. In order to facilitate insertion of the pintle wire through the connecting channel, one embodiment of the present invention provides that always one or more cross directional thread(s) is/are removed from the textile fabric in the area of the turned over edges.

The textile fabric is, for example, a warp knit structure or a leno fabric. The carrier structure is formed, for example, by only the one warp knit structure or the one leno fabric. Both of these structures can be produced very easily and cost effectively and can be pre-fabricated in almost any desired dimension in roll form and can then be fabricated according to specific dimensions of the press felt which is to be produced.

The longitudinal threads may progress, for example, straight in the carrier structure up to the point of the seam loops. In addition, the cross threads may progress straight in the carrier structure. The term "straight progression in the carrier structure", in this instance, is to be understood to mean that the threads for the provision of the carrier structure do not have a curved progression as is the case, for example, in a woven fabric. The aforementioned definition does not exclude that the threads progress curved if the carrier structure has a curved progression as is the case, for example, in a continuous carrier structure.

In a woven fabric, the threads progress alternately curved. The advantage of the straight progression of the longitudinal and/or cross threads is that less thread material is required for the production of the textile fabric. In addition, structures of this type are dimensionally more stable than a woven fabric, especially when used as a press felt, since a structure which is formed by straight threads displays less distortion caused by the force in the press nip than a woven fabric with threads with curved progression.

In order to improve the seamability, the longitudinal threads are monofilament threads since, in this case, the pintle wire can be inserted through the connecting channel more easily than would be the case if the longitudinal threads were formed by multifilament threads. The monofilament threads forming the longitudinal threads are, for example, polyamide and/or polyamide co-polymer or contain this/these materials.

To improve the tie-in of the nonwoven structure with the carrier structure, the cross threads may be multifilament and/or staple fiber threads. In multifilament threads and/or staple fiber threads, the staple fibers of the nonwoven structure can be anchored better than in monofilament threads. It is conceivable in this connection, for example, that the multifilament threads are formed from several monofilament threads which are twisted with each other. For example 4-fold threads, 6-fold threads, 9-fold threads or 10-fold threads would be feasible, only to mention a few possibilities.

The cross threads, may, for example, be positioned at a distance from each other, whereby the distance between adjacent cross threads is consistent at least with the diameter of the cross threads. In this case, the layers of the textile fabric are, for example, laid onto each other so that the cross threads of the one layer are arranged between adjacent cross threads of the other layer and vice versa. This serves to reduce the thickness of two layers placed on top of each other. In addition, the layers which are placed on top of each other are fastened to each other. It is also conceivable that the longitudinal threads are positioned at a distance from each other and that the distance between adjacent longitudinal threads is consistent with at least the diameter of the longitudinal threads. In this case, the layers of the textile fabric are, for example, laid on top each other so that the longitudinal threads of the one layer are arranged between adjacent longitudinal threads of the other layer and vice versa.

In order to reduce marking caused by local fluctuations in thickness, the diameters of the cross threads are, for example, adapted to the diameter of the pintle wire. A first embodiment of the present invention provides that the diameter of the cross threads is essentially or substantially consistent with the diameter of the pintle wire. Further, the longitudinal threads may extend, for example, in the provided machine direction and the cross threads in the provided cross machine direction of the press felt.

The method to produce a press felt according to the present invention which is seamable in a machine for the production and/or processing of a fibrous material web and which has a carrier structure includes the following steps in the manufacture of the carrier structure:

a) Provision of a flat manufactured textile fabric which is formed from longitudinal threads and cross threads crossing said longitudinal threads as well as sewing threads which connect the longitudinal and cross threads with each other at the crossing points, whereby the textile fabric is longer than the length of the carrier structure;

b) Placement of the textile fabric onto itself by placing segments of the textile fabric onto each other in a way that the carrier structure is formed by several layers of the textile fabric extending along the entire length of the carrier structure, whereby turned over edges are formed as a result of laying the sections of the textile fabric on top of each other. The turned over edges extend transversely to the longitudinal direction of the carrier structure and define one and one other transverse end of the carrier structure, whereby the longitudinal threads which progress curved in the area of the turned over edges form seam loops at the two transverse ends of the carrier structure; and c) Making the fabric structure which is laid onto itself and which forms the carrier structure continuous by bringing together the seam loops of the one transverse end and the seam loops of the other transverse end, thereby forming a connecting channel, and by inserting a pintle wire through the connecting channel.

According to a second embodiment of the present invention, the inventive method may include the additional step whereby always one or several cross directional thread(s) is/are removed from the textile fabric in the area of the turned over edge.

According to a third embodiment of the method of the present invention, the method may also include the step whereby the layers of the textile fabric which are laid on top of each other and which form the carrier structure are joined with each other. Here, it is possible that the layers are only joined with each other along lines, as this can, for example, be the case in sewing together the layers. It is also conceivable to join the surfaces of the layers with each other, as can be the case, for example, if the layers are glued together.

The flat manufactured textile fabric has two transverse edges which define the textile fabric structure in its length, as well as two longitudinal edges which define the textile fabric structure in its width. In addition, the textile fabric has a top surface and opposite to this a bottom surface.

According to a fourth embodiment of the method according to the present invention, prior to step b) a tubular structure is formed from the textile fabric. Here, it is conceivable that, in order to form the tubular structure, the textile fabric is joined with itself in the area of its two transverse edges, whereby one end section of the textile fabric which is adjacent to the one transverse edge is placed onto another end section of the textile fabric which is adjacent to the other transverse edge. For example, the placement occurs in such a way that either the top surface of the one end section is placed onto the top surface of the other end section or the bottom surface of the one end section is placed onto the bottom surface of the other end section and the end sections placed on top of each other are joined with each other at least in sections. Joining can hereby occur, for example, through a process in which the material of the textile fabric, in other words the longitudinal threads and/or the cross threads and/or sewing threads are joined with each other at least partially by fusing in the area of the two end sections of the textile fabric.

It is conceivable that after the fabrication of the tubular structure, step b) is implemented. It is further conceivable that following step c) securing of the seam loops occurs. Here, it is conceivable that after joining of the seam loops, the carrier structure which is formed from several layers of the textile fabric is carried around two rolls which are located parallel to each other and by means of which the carrier structure is tensioned in its longitudinal extension, thereby securing the seam loops in their progression. In addition to the tensioning, securing may occur with the effect of temperature. Here, it is conceivable that one or both rolls are heated. It is also conceivable to subject the textile fabric to heat treatment in a different manner during tensioning, for example through heat radiation. In addition to tensioning, the textile fabric which provides the multi-layer structure may also be carried through a press nip.

An additional method for the production of a press felt according to the present invention which is seamable in a machine for the production and/or processing of a fibrous material web and which has a carrier structure, includes the following steps during the manufacture of the carrier structure:

a) Provision of a flat manufactured textile fabric which includes longitudinal threads extending in a longitudinal direction of the press felt, whereby the textile fabric has a top and a bottom surface as well as end sections defining its length and whereby the textile fabric is longer than the carrier structure that is to be produced;

b) Formation of a tubular structure from the textile fabric by bringing together the two end sections of the textile fabric and placing of the two end sections on top of each other, whereby either the top surface in the area of the one end section is placed on the top surface in the area of the other end sections, or the bottom surface in the area of the one end section is placed on the bottom surface in the area of the other end section;

c) Joining the two end sections which were placed on top of each other;

d) Placing the tubular structure onto itself, thus forming a carrier structure with several layers placed on top of each other and with turned over edges extending transversely to the longitudinal direction of the carrier structure and which define one and one other transverse end of the carrier structure, whereby the longitudinal threads, which have a curved progression in the area of the turned over edges, form seam loops on the two transverse ends of the carrier structure;

e) Making the tubular structure which is placed onto itself and which forms the carrier structure continuous by bringing together the seam loops of the one transverse end and the seam loops of the other transverse end, thereby forming a connecting channel and by inserting a pintle wire through the connecting channel; and f) Optionally joining with each other the layers which were placed on top of each other.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
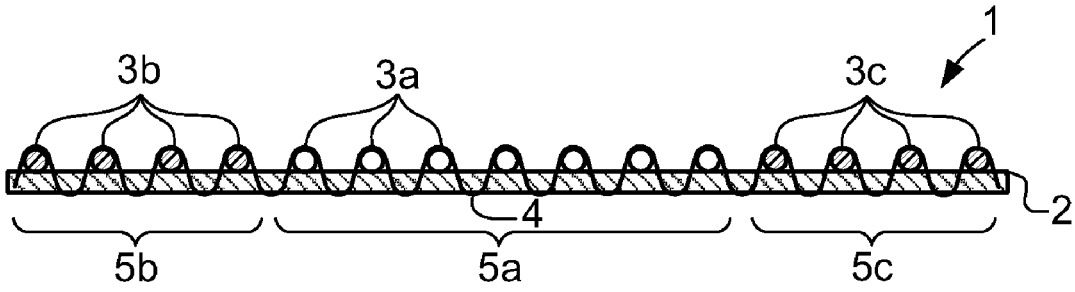
FIGS. 1*a*-1*d* illustrate an embodiment of a method for the production of a press felt according to the present invention.

Referring now to the drawings, and more particularly to FIGS. 1*a*-*d*, there is illustrated an embodiment of a method according to the present invention for the production of a press felt according to the present invention with carrier structure 11, whereby the manufacture of carrier structure 11 includes the following steps. Textile fabric 1 is provided. Textile fabric 1 is formed from longitudinal threads 2, as well as cross directional threads 3*a*, 3*b*, 3*c* which cross longitudinal threads 2. Longitudinal threads 2 are connected with cross directional threads 3*a*, 3*b*, 3*c* at the cross over points by means of sewing threads 4. In the present example, textile fabric 1 is a single layer warp knit structure. Longitudinal threads 2 are formed from a polyamide and are monofilament threads, whereas cross threads 3*a*, 3*b*, 3*c* are in the form of multifilament threads.

Warp knit structure 1 is longer than the length of carrier structure 11 which is to be manufactured. In the current example, warp knit structure 1 is approximately twice as long as carrier structure 11 which is to be produced. Viewed in its longitudinal direction, warp knit structure 1 has two end sections 5*b*, 5*c* as well as center section 5*a*, whereby two end sections 5*b*, 5*c* together have approximately the length of center section 5*a* (see FIG. 1*a*). The cross threads of end section 5*b* are designated 3*b* and those of other end section 5*c* are designated 3*c*. Cross threads 3*a*, 3*b* and 3*c* are additionally arranged at a distance from each other, whereby the distance between adjacent cross threads 3*a*, 3*b*, 3*c* is consistent at least with the diameter of cross threads 3*a*, 3*b*, 3*c* themselves.

Figure 1B:
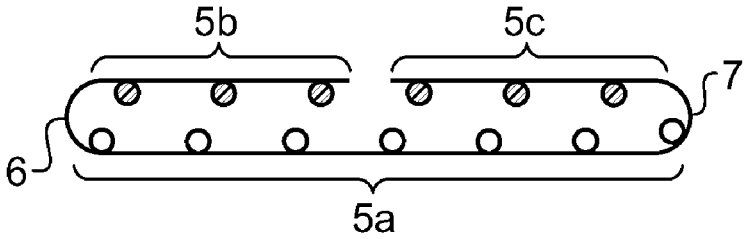
Figure 1C:
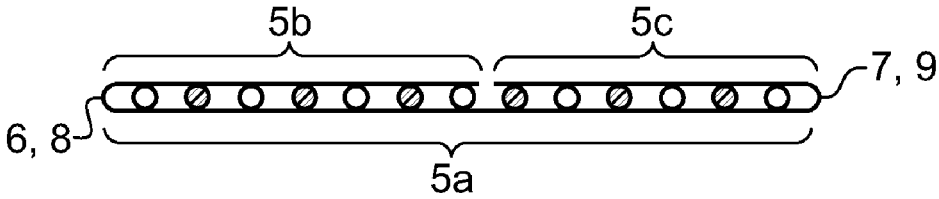
Figure 1D:
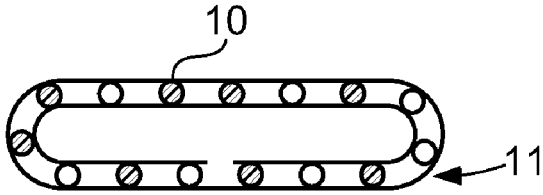

FIGS. 1*b* and 1*c* illustrate placement of textile fabric 1 onto itself. For this purpose, end sections 5*b*, 5*c* are always laid onto center section 5*a* in such a way that carrier structure 11 is formed by several layers of textile fabric 1, each layer extending along the entire length of carrier structure 11. In other words, end sections 5*b*, 5*c* together form one layer of carrier structure 11, as center section 5*a* forms one layer of carrier structure 11. By placing end sections 5*b*, 5*c* on top of each other on center section 5*a*, turned over edges 6, 7 are also formed which extend transversely to the longitudinal direction of carrier structure 11 and which define one and one other transverse end of carrier structure 11.

It can be seen in FIG. 1*c* that the layers of textile fabric 1 are placed on top of each other so that cross threads 3*b*, 3*c* of the one layer are arranged between adjacent cross threads 3*a* of the other layer and vice versa. Before placement on top of each other, or afterwards, one or several of cross threads 3*b*, 3*c* can now be removed in the area of turned over edges 6, 7 from textile fabric 1. Longitudinal threads 2, which have a curved progression in the area of turned over edges 6, 7, form seam loops 8, 9 at the two transverse ends of carrier structure 11 through which pintle wire 10 can be inserted (see FIG. 1*d*) in order to make carrier structure 11 continuous. Subsequently, the layers of textile fabric 1 which were placed on top of each other are joined with each other. This may, for example, occur through sewing together of the layers and/or needling of a nonwoven structure consisting of staple fibers.

Referring now to FIGS. 2*a-f*, there is illustrated an additional embodiment of a method for the production of an inventive press felt according to the present invention with carrier structure 11. The method according to the present invention described in FIG. 2 adds, for example, the manufacturing step which is described in FIG. 2*b* to the method illustrated in FIG. 1 in that a tubular structure is formed from textile fabric 1 before it is placed in complete layers onto itself. Textile fabric 1 has two transverse edges 18, 19 which define the textile fabric in its length, as well as top surface 20 and opposite to this bottom surface 21. To create tubular structure 25, textile fabric 1 is joined with itself in the area of transverse edges 18, 19. For this purpose, end section 26 of textile fabric 1 which adjoins transverse edge 18 is placed onto end section 27 of the textile fabric which adjoins other transverse edge 19. The placement occurs in such a way that top surface 20 of end section 26 is placed on top surface 20 of other end section 27. Subsequently, end sections 26, 27, which were placed on top of each other, are joined with each other in connecting area 24, for example by means of hot wire device 23. In the illustration in FIG. 2, connecting area 24 extends right from separation location 22. In addition, the components of end sections 26, 27, shown to the left of separation line 22 in FIG. 2, are separated from textile fabric 1 during the joining process with the hot wire device. Connecting area 24 can subsequently be smoothed, for example with the effect of ultra sound.

Figure 2A:
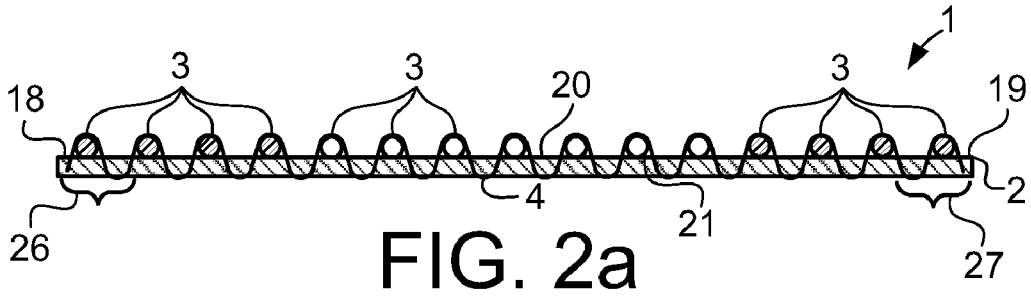
FIGS. 2*a*-2*f* illustrate an embodiment of a method for the production of a press felt according to the present invention.
Figure 2B:
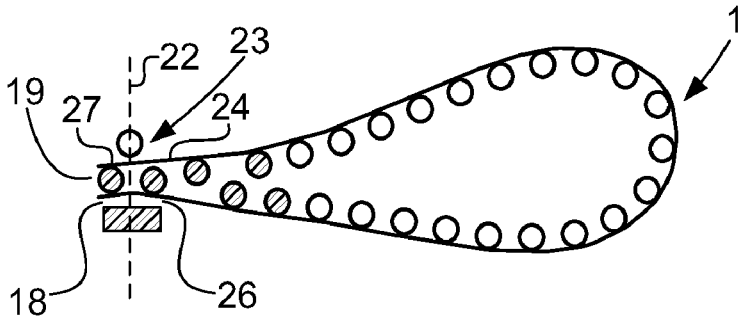
Figure 2C:
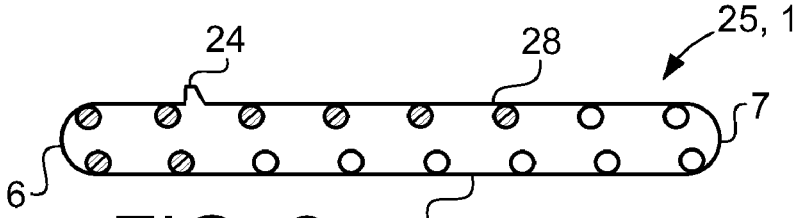
Figure 2D:
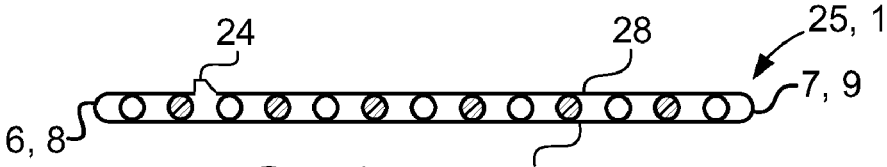

Referring now to FIGS. 2*c* and 2*d*, there is illustrated placement of tubular fabric 25 onto itself. Several—in the current example two—layers 28, 29 of textile fabric 1, each of which extend along the entire length of the carrier structure are placed onto each other, thus forming carrier structure 11. By placement onto itself of tubular structure 25, turned over edges 6, 7 are formed which extend transversely to the longitudinal direction of carrier structure 11, and which define one and one other transverse end of carrier structure 11. It can be seen in the illustration in FIG. 2*d* that layers 28, 29 of textile fabric 1 are placed on top of each other in such a way that cross threads 3 of layer 28 are arranged between adjacent cross threads 3 of layer 29, and vice versa. Before placement on top of each other, or afterwards, one or several of cross threads 3 can now be removed from textile fabric 1 in the area of turned over edges 6, 7. Longitudinal threads 2, which have a curved progression in the area of turned over edges 6, 7, form seam loops 8, 9 at the two transverse ends of carrier structure 11. Layers 28, 29 of tubular structure 25 which were laid on top of each other can be joined with each other. This can occur, for example, through sewing together layers 28, 29.

Figure 2E:
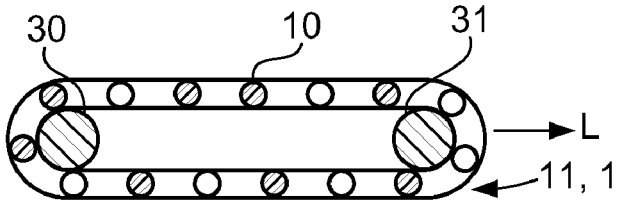
Figure 2F:
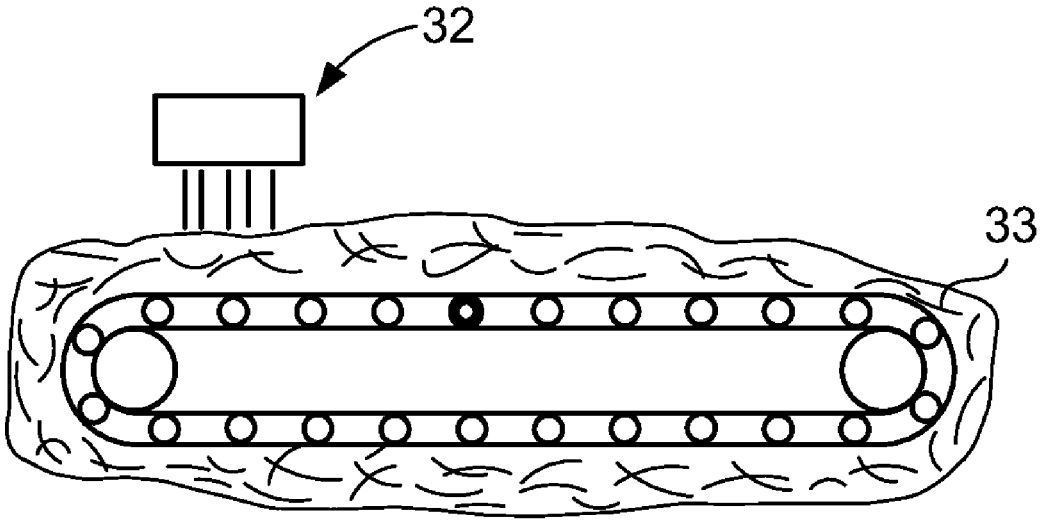

In the process step illustrated in FIG. 2*e*, tubular structure 25, which was placed onto itself, is made continuous for further production of carrier structure 11, whereby seam loops 8, 9 of the two transverse ends are brought together, thus forming a connecting channel through which pintle wire 10 is inserted (see FIG. 2*e*). While making tubular structure 25 which was laid onto itself continuous, it is carried around rolls 30, 31 which are located parallel to and at a distance from each other. Their distance to each other in direction L is changeable and can be increased so that a tension can be generated on carrier structure 11 in its longitudinal progression, or in other words in the longitudinal direction of the longitudinal threads. This enables seam loops 8, 9 to be secured in their form. In the current example, at least one roll 30, 31 is heated, so that securing of seam loops 8, 9 occurs under the effects of tension and temperature. After the securing step, carrier structure 11 is brought to needling device 32 by means of which nonwoven structure 33, which includes staple fibers, is needle bonded with carrier structure 11.

Figure 3:
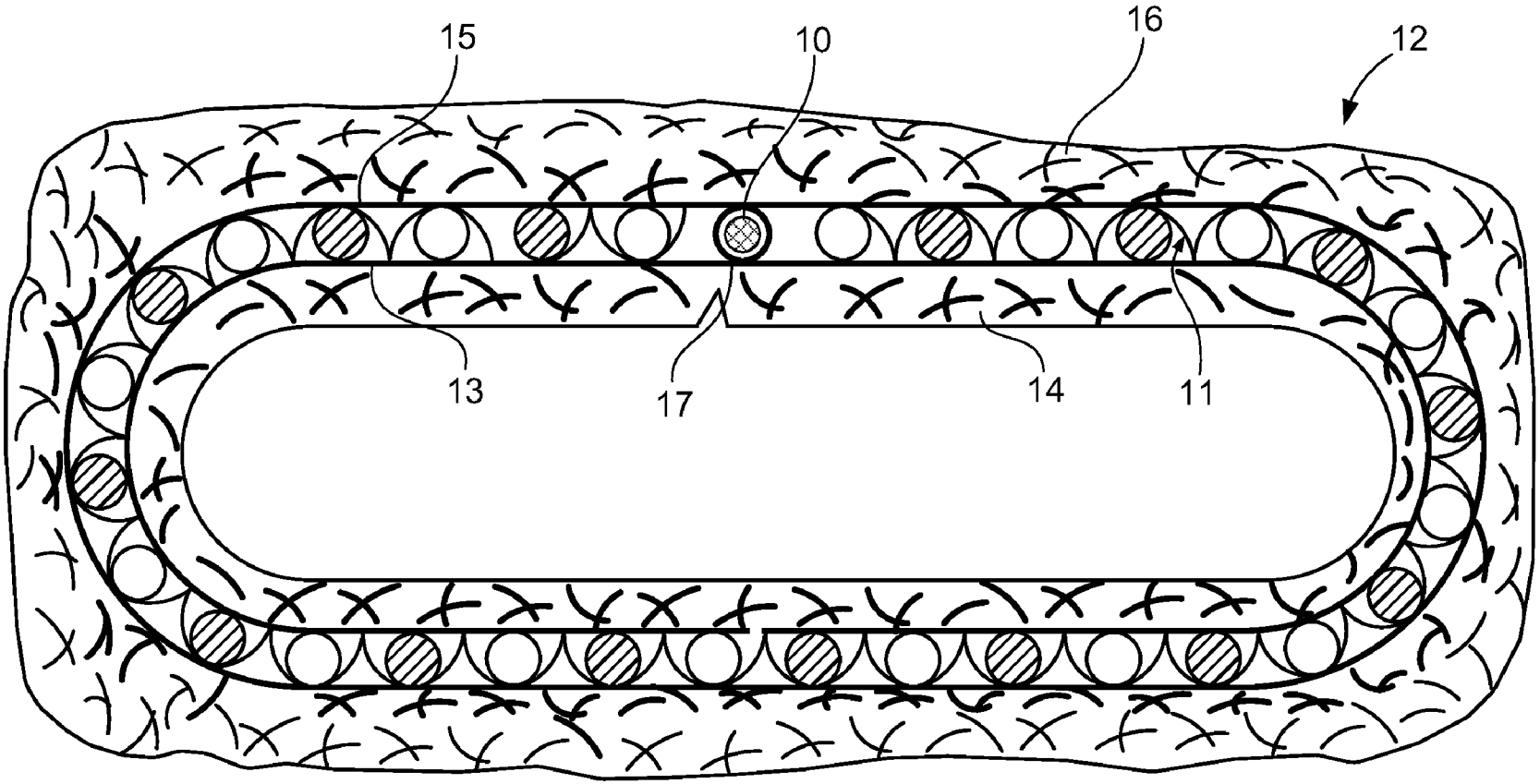
FIG. 3 illustrates an embodiment of a press felt according to the present invention.

Referring now to FIG. 3, there is illustrated completed press felt 12 according to the present invention. Press felt 12 includes carrier structure 11 illustrated in FIGS. 1 and 2 which, on side 13 facing the machine, is needled with one or more machine side nonwoven fiber layers 14 and on side 15 facing the fibrous web is needled with one or more paper side nonwoven fiber layers 16. In the area of seam loops 8, 9, nonwoven fiber layers 14, 16 are severed across their entire width (machine cross direction) and their entire thickness through to carrier structure 11, so that press felt 12 according to the present invention can be seamed in a paper, cardboard or tissue machine, whereby the two transverse ends of carrier structure 11 are brought together for the purpose of making carrier structure 11 continuous and seam loops 8, 9 mesh with each other, forming connecting channel 17 which progresses in the transverse direction of carrier structure 11 and through which connecting channel 17 pintle wire 10 is inserted to connect seam loops 8, 9 of carrier structure 11.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press felt for a machine for at least one of the production and processing of a fibrous material web, said press felt comprising:

a continuous carrier structure configured to fundamentally influence dimensional stability of the press felt and configured to be seamable in a paper machine, said carrier structure including a flat manufactured textile fabric formed of a plurality of longitudinal threads, a plurality of transverse threads crossing said longitudinal threads at crossing points and a plurality of sewing threads connecting said longitudinal threads and said transverse threads to each other at said crossing points, each of said cross threads having a diameter and being positioned at a distance from each other, said distance between said cross threads adjacent to each other being at least said diameter of said cross threads, said carrier structure having a first length and said textile fabric having a second length longer than said first length and said textile fabric being laid onto itself in sections forming a plurality of layers of said carrier structure and extending along said entire length of said carrier structure, said layers of the textile fabric being laid onto each other so that said cross threads of one of said layers are arranged between said adjacent cross threads of another of said layers and said layers being connected with each other in at least sections of said layers, wherein said configuration of said sections of said textile fabric on top of each other forms turned over edges extending transversely to a longitudinal direction of said carrier structure and defines one transverse end of said carrier structure and one other transverse end of said carrier structure, wherein in an area of said turned over edges said longitudinal threads have a curved progression forming seam loops on each of said transverse ends of said carrier structure, said two transverse ends being brought together and said seam loops meshing with each other to form a connecting channel extending in a cross direction of said carrier structure; and a pintle wire positioned through said connecting channel of said carrier structure.

2. The press felt according to claim 1, wherein at least one of said cross directional threads is removed from said textile fabric in said area of said turned over edges.

3. The press felt according to claim 1, wherein said textile fabric is one of a warp knit structure and a leno fabric.

4. The press felt according to claim 1, wherein said longitudinal threads in said carrier structure progress straight up to an area of said seam loops.

5. The press felt according to claim 1, wherein said cross threads in said carrier structure progress straight.

6. The press felt according to 3, wherein said carrier structure is formed only by said one of said warp knit structure and said leno fabric.

7. The press felt according to claim 1, wherein said longitudinal threads are monofilament threads.

8. The press felt according to claim 1, wherein said cross threads are at least one of multifilament threads and staple fiber threads.

9. The press felt according to claim 8, wherein said multifilament threads are twisted threads.

10. The press felt according to claim 1, wherein each of said longitudinal threads has a diameter and is positioned at a distance from each other, said distance between said longitudinal threads adjacent to each other being at least said diameter of said longitudinal threads.

11. The press felt according to claim 10, wherein said layers of said textile fabric are laid on top each other so that said longitudinal threads of said one layer are arranged between said adjacent longitudinal threads of said other layer.

12. The press felt according to claim 1, wherein said diameter of said cross threads is substantially equal to a diameter of said pintle wire.

13. The press felt according to claim 1, wherein said longitudinal threads extend in a machine direction and said cross threads extend in a cross machine direction.

14. A method to produce a press felt which is seamable in a machine for at least one of the production and processing of a fibrous material web and which has a carrier structure, said method of manufacture of said carrier structure including the steps of:

a) providing a flat manufactured textile fabric formed from a plurality of longitudinal threads, a plurality of crossing threads crossing said longitudinal threads at crossing points and a plurality of sewing threads connecting said longitudinal threads and said cross threads with each other at said crossing points, each of said cross threads having a diameter and being positioned at a distance from each other, said distance between said cross threads adjacent to each other being at least said diameter of said cross threads, said carrier structure having a first length and said textile fabric having a second length longer than said first length;

b) placing said textile fabric onto itself by placing segments of said textile fabric onto each other such that said carrier structure is formed by a plurality of layers of said textile fabric extending along said entire length of said carrier structure, said layers of the textile fabric being laid onto each other so that said cross threads of one of said layers are arranged between said adjacent cross threads of another of said layers, whereby turned over edges are formed by said laying of said sections of said textile fabric on top of each other, said turned over edges extending transversely to a longitudinal direction of said carrier structure and defining one transverse end and one other transverse end of said carrier structure, whereby said longitudinal threads progress curved in an area of said turned over edges to form seam loops at said two transverse ends of said carrier structure; and c) making said textile fabric which is laid onto itself to form a fabric structure and forms said carrier structure continuous by bringing together a plurality of seam loops of said one transverse end and another plurality of seam loops of said other transverse end, thereby forming a connecting channel and inserting a pintle wire through said connecting channel.

* * * * *